United States Patent [19]

Ebisawa et al.

[11] 4,436,140

[45] Mar. 13, 1984

[54] METHOD OF CHARGING MOLTEN METAL INTO A VERTICAL DIE CASTING MACHINE

[75] Inventors: Masuo Ebisawa, Kawagoe; Tetsuya Suzuki, Oimachi, both of Japan

[73] Assignee: Honda Giken Kogyo Kabushiki Kaisha, Tokyo, Japan

[21] Appl. No.: 397,161

[22] Filed: Jul. 12, 1982

Related U.S. Application Data

[63] Continuation of Ser. No. 113,762, Jan. 21, 1980, abandoned.

[30] Foreign Application Priority Data

Jan. 26, 1979 [JP] Japan ..... 54-7888

[51] Int. Cl.[3] ..... B22D 17/12

[52] U.S. Cl. ..... 164/120; 164/284; 164/313

[58] Field of Search ..... 164/113, 120, 313, 284

[56] References Cited

U.S. PATENT DOCUMENTS

| | | | |
|---|---|---|---|
| 1,555,285 | 9/1925 | Hoey | 164/120 |
| 2,804,666 | 9/1957 | Saives | 164/313 |
| 2,810,942 | 10/1957 | Saives | 164/313 |

FOREIGN PATENT DOCUMENTS

| | | | |
|---|---|---|---|
| 45-52350 | 10/1970 | Japan | 164/120 |
| 55-100865 | 8/1980 | Japan | 164/120 |
| 843959 | 8/1960 | United Kingdom . | |
| 980146 | 1/1965 | United Kingdom | 164/120 |
| 549250 | 5/1977 | U.S.S.R. | 164/313 |

*Primary Examiner*—Gus T. Hampilos
*Assistant Examiner*—J. Reed Batten, Jr.
*Attorney, Agent, or Firm*—Irving M. Weiner; Pamela S. Burt; John L. Shortley

[57] ABSTRACT

A method of charging molten metal into a vertical die casting machine, wherein molten metal is introduced into a lower sleeve in which a lower plunger is slidably received, to store therein a mass of molten metal having a surface level not higher than the bottom of a molten metal inlet to a mold cavity. Next, an upper plunger is lowered to a predetermined position, raising the lower plunger to urge the molten metal upwardly and move it into the mold cavity. The upper plunger can then be moved to apply pressure to the molten metal. The method ensures smooth charging of molten metal and casting of a product free of casting defects.

5 Claims, 6 Drawing Figures

METHOD OF CHARGING MOLTEN METAL INTO A VERTICAL DIE CASTING MACHINE

This is a continuation of application Ser. No. 113,762 filed Jan. 21, 1980 and now abandoned.

BACKGROUND OF THE INVENTION

1. Field of the Invention

The present invention relates to an improved method of charging molten metal into the mold cavity of a vertical die casting machine.

2. Description of Relevant Art

A widely known method of charging molten metal into a vertical die casting machine comprises the steps of: feeding molten metal onto a lower plunger in the raised position thereof; lowering the lower closure plunger synchronously with an upper plunger, in accordance with a direction for lowering the lower plunger, to thereby open a runner opening; and injecting the molten metal into a mold cavity. It is important in connection with such injection to lower the lower plunger synchronously at a predetermined timing and speed in accordance with the operation of the upper plunger. However, it is very difficult to synchronize the lower plunger with the upper plunger precisely for each injection, because variations arise in the amount of metal poured, the pre-set level of timing, etc. Such a known method is disclosed, for example, in British Patent Specification No. 843,959 published on Aug. 10, 1960.

If a large amount of molten metal is poured, for example, the upper plunger is brought into contact with the molten metal before the direction to lower the lower plunger is given. Pressure develops in the molten metal sleeve, and causes a part of the metal to enter the clearance between the sleeve and the plunger where they are in sliding contact with each other. This results in undesirable spattering of a part of the molten metal out of the machine, or solidification of the metal in the area between the sleeve and the plunger, adversely affecting the operation of the plunger. Because the molten metal comes to be under a high pressure, it spurts out from the runner opening when the opening is opened, and is extremely difficult to charge into the mold cavity smoothly.

If the amount of molten metal is too small, the upper plunger does not exert pressure on the molten metal until after the lower plunger opens the runner opening to permit the molten metal to flow into the mold cavity. Thus, smooth charging cannot be expected in such case. Also, because the upper plunger is brought into contact with the molten metal with some delay after the metal has flowed into the mold cavity, and causes the metal to flow into the mold cavity again, there arises a number of defects having an adverse affect on the quality of the casting produced. Such defects include, for example, cold shut, inclusion of air forming cavities, and shrinkage cavities formed upon solidification. According to the commonly-known die casting operation, it is difficult to pour additional molten metal to compensate for solidification shrinkage and to provide solidification under pressure because the operation normally involves a high rate of solidification and a narrow sprue.

A further disadvantage attendant the conventional method described hereinabove resides in the complicated construction of the synchronous driving mechanisms for the upper and lower plungers. The mechanisms are expensive, with a resultant increase in the overall cost of production, which cost is further increased due to the reduction in the yield of production caused by the above set forth disadvantages.

The present invention provides an effective solution to the foregoing various problems attendant the conventional method of charging molten metal under pressure into a vertical die casting machine.

SUMMARY OF THE INVENTION

The present invention provides a method of charging molten metal into a vertical die casting machine, which comprises the steps of: pouring molten metal into a lower sleeve in which a lower plunger is slidably received to store the molten metal on the lower plunger at a level equal to, or lower than, the bottom of a molten metal inlet to a mold cavity; lowering an upper plunger down to a predetermined position; raising the lower plunger to raise the molten metal; allowing the molten metal to flow into the mold cavity; and causing the upper plunger to exert pressure upon the molten metal.

According to the invention, it is possible to cause the molten metal to flow into and fill the mold cavity very gently and smoothly by raising the lower plunger. Thus, the formation of any cold shut, air inclusion, or shrinkage cavity is restricted and prevented, whereby die casting products of improved quality can be obtained. The present inventive method also makes it possible to obtain a dense die casting product having no blisters or other defects, even if heat treatment or surface treatment is provided so as to improve the strength of the product.

The present invention also provides a smooth and reliable method of charging molten metal which makes it possible to eliminate the synchronizing mechanisms for the upper and lower plungers, simplify the construction of an injection device, and, notwithstanding such advantages, to obtain die casting products of high quality regardless of the amount of metal to be poured.

A further advantage afforded by the present invention resides in the prevention of entry of any oxide or other impure matter floating on the surface of the molten metal into the mold cavity, thus avoiding any resulting casting defects.

In order to further ensure the aforementioned advantages and utility, it is a secondary object of the present invention to provide a vertical die casting machine which employs an upper plunger and an upper sleeve having a substantially smaller diameter than a lower plunger and a lower sleeve.

The present invention will be described in further detail hereinbelow with reference to preferred embodiments thereof as shown in the accompanying drawings. Other objects and advantages of the invention will become apparent from the following detailed description.

DETAILED DESCRIPTION OF PREFERRED EMBODIMENTS

Figure 1:
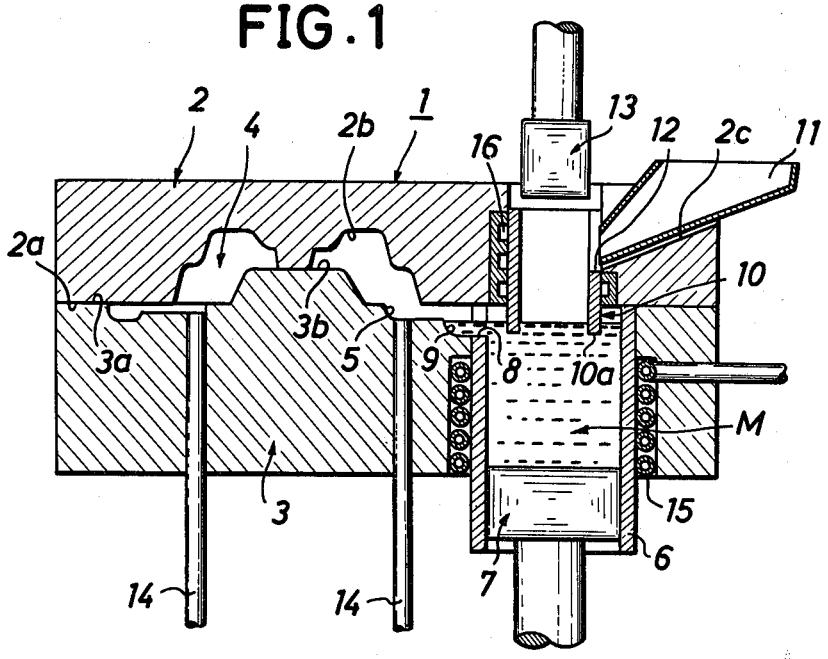
FIG. 1 is an explanatory vertical sectional view of a vertical die casting machine employed for carrying out the method in accordance with the present invention, in which molten metal is stored.

With reference to FIG. 1, there is shown the construction of a vertical die casting machine employed for carrying out the method according to the present invention.

A die casting machine 1 comprises an upper mold half 2 and a lower mold half 3. The respective joint surfaces 2*a* and 3*a* of the halves 2 and 3 are provided respectively with a recess 2*b* and a projection 3*b* which define a mold cavity 4 when the mold halves 2 and 3 are joined together. As shown in FIG. 1, the recess 2*b* has a bottom positioned at a higher level than the joint surface 2*a* of upper mold half 2. The joint surface 3*a* of the lower mold half 3 is provided with a downwardly recessed runner 5 communicating with the mold cavity 4.

A lower plunger sleeve 6 is substantially vertically disposed in a lower passageway in the lower mold half 3 adjacent to runner 5, and a lower plunger 7 is slidably received in sleeve 6. The sleeve 6 is surrounded by means 15 for heating molten metal stored therein to reduce the heat loss thereof. The sleeve 6 has an upper end which abuts on the joint surface 2*a* of upper mold half 2 when the two mold halves 2 and 3 are joined together. The upper end of sleeve 6 is partially recessed to define an opening 8 which faces runner 5. The opening 8 communicates with runner 5 through a recessed connecting passage 9 formed in the joint surface of lower mold half 3.

An upper plunger sleeve 10 positioned substantially opposite to lower sleeve 6 is substantially vertically mounted in an upper passageway in upper mold half 2, and is sufficiently smaller in diameter than lower sleeve 6. The lower end 10*a* of sleeve 10 has an appropriate length so as to extend into the upper end of lower sleeve 6, and projects downwardly below the joint surface 2*a* of upper mold half 2 so that the lower end 10*a* of upper sleeve 10 may be positioned below the level of runner 5. The upper mold half 2 is provided adjacent to sleeve 10 with a recessed portion 2*c* in which a hopper shaped pouring cup member 11 is mounted. The upper sleeve 10 is provided with an opening 12 communicating with pouring cup member 11. An upper plunger 13 is supported above sleeve 10, and is slidably receivable therein. The upper sleeve 10 is surrounded by cooling means 16. The lower mold half 3 is provided with ejector pins 14 each having a top facing the bottom of mold cavity 4.

When the upper and lower mold halves 2 and 3 are joined together, and the recess 2*b* and projection 3*b* define the mold cavity 4, the lower plunger 7 stays in the lower portion of its sleeve 6. The upper plunger 13 is positioned above its sleeve 10, so that opening 12 communicating with pouring cup 11 remains open. Molten metal is poured into the upper sleeve 10 through the pouring cup 11, and is collected on lower plunger 7 so as to be stored in lower sleeve 6. The molten metal M fills the lower sleeve 6, and has a surface level higher than the lower end 10*a* of upper sleeve 10 which is immersed in the molten metal. The molten metal M flows into the passage 9 through the recess 8, but does not flow into the mold cavity 4, because runner 5 is positioned at a higher level than passage 9, and a higher level than the surface level of molten metal M, as shown in FIG. 1. The heat loss of the molten metal M is restricted because it is heated by the heating means 15.

Figure 2:
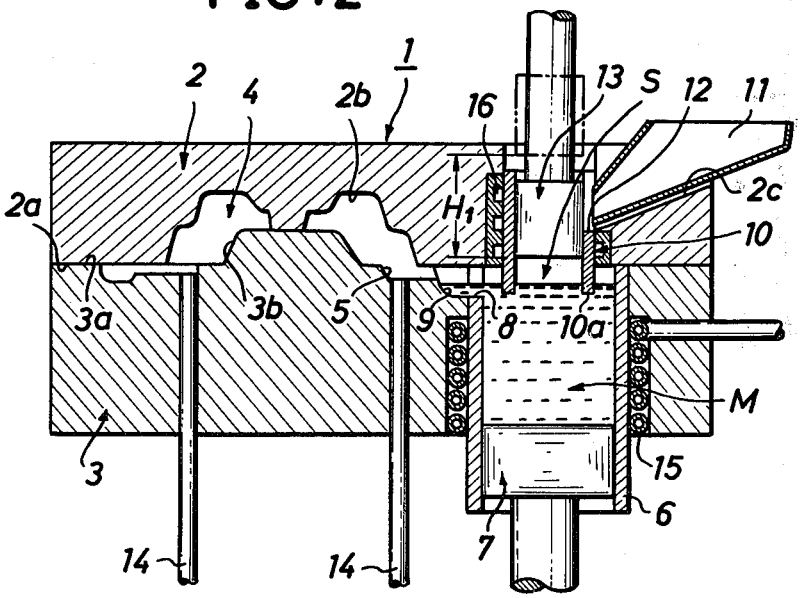
FIG. 2 is a view similar to FIG. 1, showing the upper plunger lowered to a predetermined position.

Next, the upper plunger 13 is lowered from the position thereof shown in FIG. 1, fitted in the upper sleeve 10, slidably moved downwardly therein until it has been lowered by a predetermined distance $H_1$ (FIG. 2), and stopped. When the upper plunger 13 has been lowered by the distance $H_1$, the bottom surface thereof is still spaced above the stationary surface of the molten metal M to maintain a clearance S between the bottom surface of the plunger 13 and the surface of the molten metal M, and closes the opening 12 of the upper sleeve 10 through which molten metal is poured. Such position, at which the upper sleeve 10 has received therein the upper plunger 13, is shown in FIG. 2.

Figure 3:
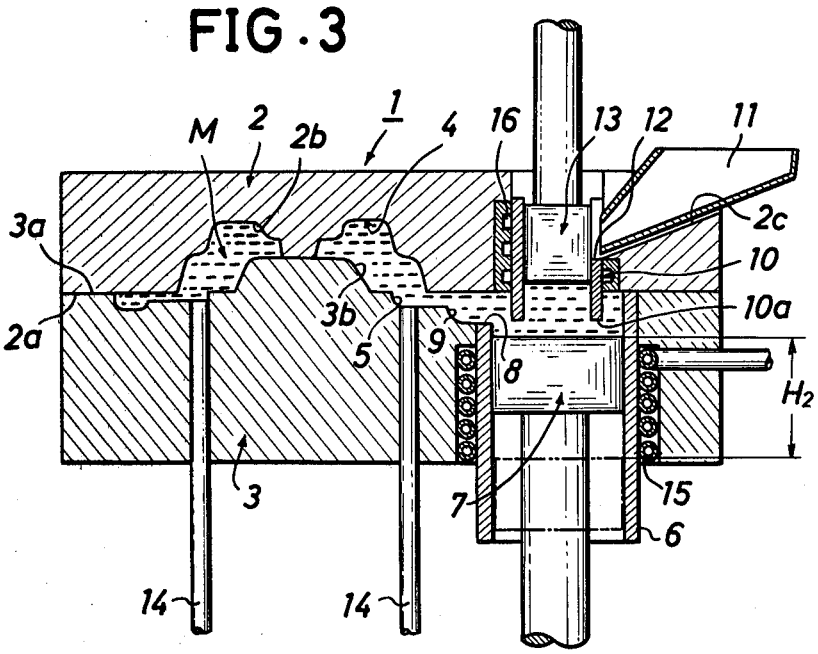
FIG. 3 is a view similar to FIG. 2, showing the charging of molten metal into the mold cavity by raising the lower plunger.

After the upper sleeve 10 has received therein the upper plunger 13, the lower plunger 7 supporting the molten metal M in the lower sleeve 6 is raised by a distance $H_2$ (FIG. 3). The distance $H_2$ is such that plunger 7 still remains spaced below the lower end of upper sleeve 10, while a sufficient clearance is maintained between the upper end of lower plunger 7 and the lower end of upper sleeve 10. With such upward movement of lower plunger 7, the volume of the lower sleeve 6 is substantially reduced, while the volume of upper sleeve 10 is restricted by the upper plunger 13, so that the combined volume defined between the lower plunger 7 and the upper plunger 13 is also substantially reduced. Thus, the molten metal M is urged to flow into the mold cavity 4 through the opening 8, the passage 9 and the runner 5, and fills the mold cavity 4 to a primary extent.

The primary charging of molten metal M is gently carried out by raising the lower plunger 7. To this end, it is sufficient for the lower plunger 7 to push up the molten metal M such that only an extremely low pressure is exerted on the molten metal M, to prevent problems such as metal penetration between the plungers and the sleeves, or spattering of the metal. The molten metal M is charged into the mold cavity gently and smoothly by such application of low pressure, and air which would otherwise normally be present heretofore in a spurted molten metal, is excluded. The molded product is free from any cavity or like defect. Because the molten metal stored on the lower plunger is continuously delivered into the mold cavity without any interruption, no cold shut, shrinkage cavity or like defect appears in the molded product. The primary charging operation described hereinabove is shown in FIG. 3.

Figure 4:
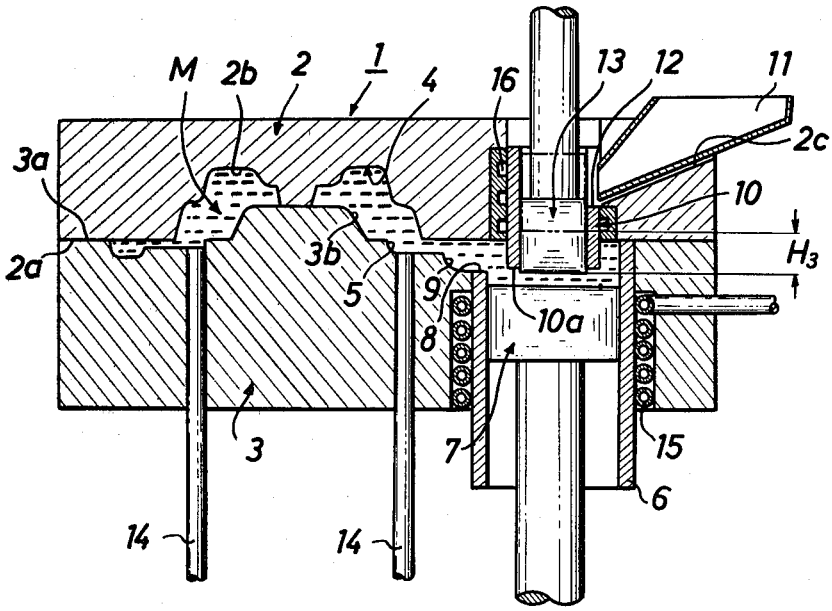
FIG. 4 is a view similar to FIG. 3, in which final application of pressure has been achieved between the plungers.

Substantially at the time when, or before, the primary charging of molten metal has been completed by the upward movement of lower plunger 7 to the predetermined position described hereinabove, a signal or direction is transmitted to initiate downward movement of upper plunger 13 such that it is lowered by a distance $H_3$ (FIG. 4). The upper plunger 13 compresses the molten metal M in the lower sleeve 6, and this metal in turn pressurizes the molten metal M in the mold cavity 4, whereby secondary charging is carried out for compacting the structure of the metal. Such secondary charging operation is shown in FIG. 4.

Any oxide formed on the surface of the molten metal by oxidation with air is confined within upper sleeve 10 upon upward movement of lower plunger 7, without being carried over into the mold cavity 4 during such stage of the operation. Any such oxide does not flow back into the molten metal to be delivered into the mold cavity 4 until the very end of the final application of pressure. Therefore, any such oxide is effectively prevented from being carried forward into the mold cavity 4. Such feature combines with the aforementioned advantages to provide a casting product having a very high quality.

Because upper sleeve 10 is substantially smaller in diameter than lower sleeve 6, and the lower end of upper sleeve 10 projects into the upper end of lower sleeve 6, any and all metal oxide formed on the surface of the molten metal is confined within upper sleeve 10 during the transit from the position shown in FIG. 2 to that of FIG. 3, and during the primary charging operation shown in FIG. 3, and is prevented from flowing into mold cavity 4. Such oxide mixes into the molten metal in lower sleeve 6 only when plunger 13 has been lowered to the bottom of upper sleeve 10 at the end of final application of pressure by upper plunger 13. Therefore, it is possible to prevent any such oxide from mixing into that portion of the molten metal which forms a molded product. Because upper plunger 13 and sleeve 10 are smaller in diameter than lower plunger 7 and its sleeve 6, they are capable of applying pressure to highly fluidic molten metal in the center of the molten mass having less heat loss, thus rendering it possible to provide a casting of very high quality having no shrinkage cavity or like defect.

Figure 5:
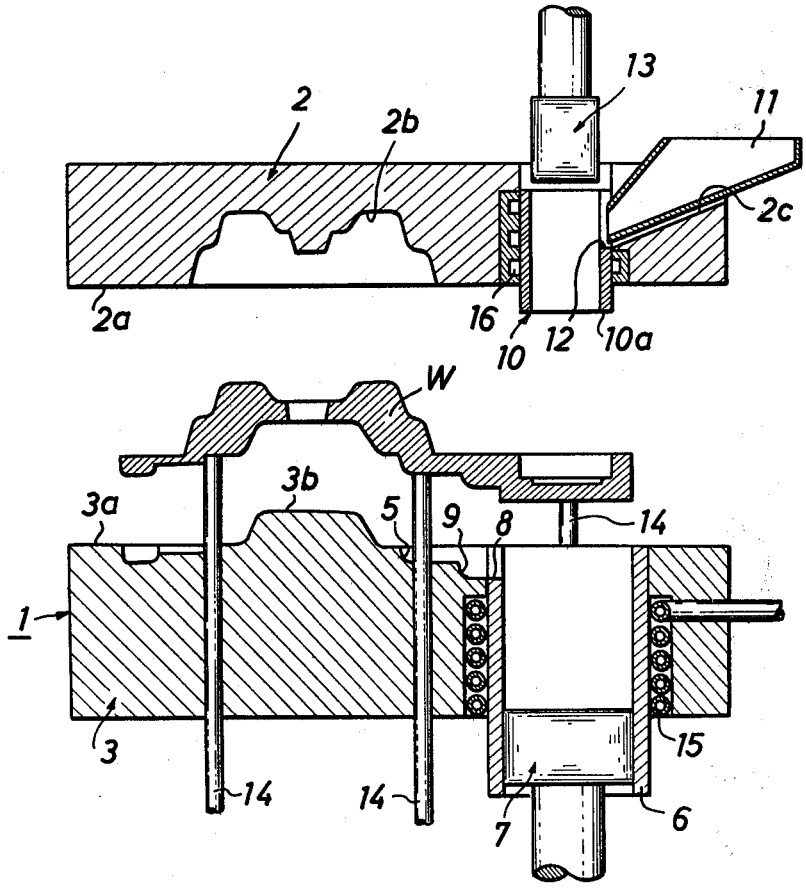
FIG. 5 illustrates ejection of a casting product.

When the molten metal has solidified, the upper mold half 2, together with upper sleeve 10 and plunger 13, is raised, and separated from lower mold half 3, and the ejector pins 14 are actuated to eject a casting product W, as shown in FIG. 5.

Figure 6:
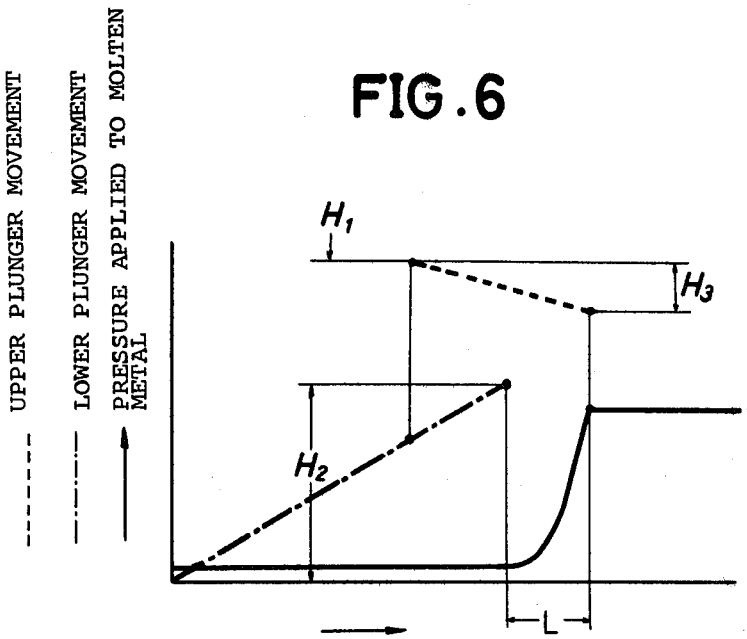
FIG. 6 is a graph explaining the method according to the present invention in relation to plunger displacement, pressure and time.

According to the present invention, it is possible to control the timing for completing pressurization by selecting the timing for pressurization by the upper plunger in relation to the movement of the lower plunger, as shown in FIG. 6. In other words, timing differences L can be provided between the end of lower plunger movement and the end of pressurization by the upper plunger, so that an additional or secondary supply of molten metal can be charged into the mold cavity in accordance with the rate of solidification shrinkage and the charging speed. Thus, as shown by the overlapping times of movement of the upper and lower plungers represented in FIG. 6, secondary charging of the molten metal can be selectively initiated, by lowering upper plunger 13, before completion of the primary charging effected by upward movement of lower plunger 7, or alternatively just after completion of the primary charging.

Although there have been described what are at present considered to be the preferred embodiments of the invention, the present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

We claim:

1. A method of charging molten metal into a vertical die casting machine comprising: a die having an upper passageway and a lower passageway defined therein, said upper passageway including an upper sleeve disposed therein and an upper plunger disposed in said upper passageway for compressing said molten metal, said lower passageway including a lower sleeve and a lower plunger disposed in said lower passageway for receiving said molten metal, both of said plungers cooperating to charge molten metal stored therebetween into a mold cavity defined in said die, and the gap between said upper and lower sleeves defining an inlet passage to said mold cavity, the method comprising the steps of:

lowering said upper plunger to a predetermined position;

raising said lower plunger to urge said molten metal upwardly and into said mold cavity;

actuating said upper plunger to start compressing said molten metal sandwiched between said upper and lower plungers substantially before movement of said lower plunger has been completed; and completing compression of said molten metal by said upper plunger substantially after movement of said lower plunger has been completed, and prior to solidification of said molten metal between said plungers.

2. A method of charging molten metal according to claim 1, wherein:

said lowering of said upper plunger to said predetermined position confines said molten metal within said lower sleeve and said upper sleeve.

3. A method of charging molten metal according to claim 2, wherein:

said actuating of said upper plunger aids in charging said molten metal into said mold cavity.

4. A method of charging molten metal according to claim 1, wherein:

said upper plunger exerts pressure upon said molten metal only in the central portion of the mass of said molten metal in said lower sleeve.

5. A method of charging molten metal according to claim 1, wherein:

said upper plunger and said upper sleeve are smaller in diameter than said lower plunger and said lower sleeve, said upper sleeve extending into said lower sleeve.

* * * * *